US011763782B2

(12) United States Patent
Tóth et al.

(10) Patent No.: US 11,763,782 B2
(45) Date of Patent: Sep. 19, 2023

(54) BOWED INSTRUMENT

(71) Applicants: Károly Tóth, Budapest (HU); István Várdai, Budapest (HU)

(72) Inventors: Károly Tóth, Budapest (HU); István Várdai, Budapest (HU)

( * ) Notice: Subject to any disclaimer, the term of this patent is extended or adjusted under 35 U.S.C. 154(b) by 26 days.

(21) Appl. No.: 17/442,407

(22) PCT Filed: Mar. 18, 2020

(86) PCT No.: PCT/HU2020/000010

§ 371 (c)(1),
(2) Date: Mar. 17, 2022

(87) PCT Pub. No.: WO2020/194002

PCT Pub. Date: Oct. 1, 2020

(65) Prior Publication Data

US 2022/0284871 A1 Sep. 8, 2022

(30) Foreign Application Priority Data

Mar. 27, 2019 (HU) ..... P1900095
Jan. 28, 2020 (HU) ..... P2000031

(51) Int. Cl.
*G10D 1/02* (2006.01)
*G10D 3/13* (2020.01)
*G10D 3/04* (2020.01)

(52) U.S. Cl.
CPC ..... *G10D 1/02* (2013.01); *G10D 3/04* (2013.01); *G10D 3/13* (2020.02)

(58) Field of Classification Search
CPC ..... G10D 1/02; G10D 3/13; G10D 3/04
See application file for complete search history.

(56) References Cited

U.S. PATENT DOCUMENTS 885,067 A * 4/1908 Mitchell ..... G10D 3/046 84/311
960,317 A * 6/1910 Harmon ..... G10D 1/02 84/274
1,721,826 A * 7/1929 Longiaru ..... G10D 3/046 84/311
1,918,084 A * 7/1933 Chase ..... G10D 1/02 984/103

(Continued)

FOREIGN PATENT DOCUMENTS

FR 2939952 A1 * 6/2010 ..... G10D 3/12

*Primary Examiner* — Robert W Horn
(74) *Attorney, Agent, or Firm* — Olson & Cepuritis, Ltd.

(57) ABSTRACT

The object of the invention is a bowed instrument comprising a body (2) and a neck (1), the upper face of the body (2) being the top plate (4), at the bottom of which a tailpiece is disposed secured to the bottom of the instrument, the strings (14) being disposed in a tensioned state, supported from below by a bridge, between the tailpiece and the scroll (8) of the neck (1). The bowed instrument according to the invention comprises a tailpiece (16) that is adapted to retain the bottom portion of the strings (14), has an arcuate triangular shape, has an asymmetrically shaped body made of a multilayered material, and is rounded along the periphery of its body, wherein bores (20) adapted for receiving the strings (14) are disposed at the bottom corner (a) and along the arced portion (9) extending between the two upper corners (b, c) thereof.

11 Claims, 4 Drawing Sheets

(56) References Cited

U.S. PATENT DOCUMENTS 2,184,790 A * 12/1939 Bartoli ..... G10D 3/046 84/311
2,198,297 A * 4/1940 Ham ..... G10D 3/046 84/311
2,388,550 A * 11/1945 Kingman ..... G10D 3/046 84/311
2,495,343 A * 1/1950 Ohab ..... G10D 3/046 84/311
2,588,238 A * 3/1952 Hogne ..... G10D 3/13 984/118
3,096,676 A * 7/1963 Havivi ..... G10D 3/13 984/118
3,489,051 A * 1/1970 Weiss ..... G10D 3/046 84/311
3,552,255 A * 1/1971 Kaston ..... G10D 3/046 84/310
3,853,032 A * 12/1974 Freeman ..... G10D 1/02 984/103
4,334,455 A * 6/1982 Beecher ..... G10D 1/02 984/118
5,123,326 A * 6/1992 Clevinger ..... G10D 3/02 84/723
6,294,718 B1 * 9/2001 Saunders, Jr. ..... G10D 3/02 800/290
6,538,183 B2 * 3/2003 Verd ..... G10D 3/22 84/290
7,304,225 B2 * 12/2007 Ricci ..... G10D 1/02 84/302
7,411,120 B2 * 8/2008 Dai ..... G10D 1/02 84/274
7,598,444 B2 * 10/2009 Farnell, Jr. ..... G10D 1/085 84/291
7,906,716 B1 * 3/2011 Wiessmeyer ..... G10D 3/046 84/273
8,227,678 B2 * 7/2012 Frirsz ..... G10D 3/13 84/411 R
8,766,068 B2 * 7/2014 Frirsz ..... G10D 3/14 84/297 R
10,008,185 B2 * 6/2018 Rulifson ..... G10D 3/22
11,482,201 B1 * 10/2022 Heard ..... G10D 13/08
11,501,743 B1 * 11/2022 Threlkeld-Wiegand ..... G10D 1/00
2003/0217633 A1 * 11/2003 McPherson ..... G10D 1/02 84/274
2012/0285311 A1 * 11/2012 Frirsz ..... G10D 1/02 84/297 R
2014/0305278 A1 * 10/2014 Frirsz ..... G10D 3/14 84/297 R
2020/0338867 A1 * 10/2020 Luttwak ..... B32B 9/047
2020/0365120 A1 * 11/2020 Warner ..... G10D 1/02
2021/0225335 A1 * 7/2021 Canel ..... G10D 3/04
2022/0284871 A1 * 9/2022 Töth ..... G10D 1/02

* cited by examiner

BOWED INSTRUMENT

CROSS-REFERENCE TO RELATED APPLICATIONS

This application is a U.S. National Stage of PCT/HU2020/000010, filed 18 Mar. 2020, which claims priority of Hungarian Patent Application No. P1900095, filed 27 Mar. 2019 and Hungarian Patent Application No. P2000031, filed 28 Jan. 2020.

TECHNICAL FIELD

The object of the invention is a bowed instrument comprising a body and a neck, the upper face of the body being the top plate, at the bottom of which a tailpiece is secured to the bottom of the instrument, the strings being disposed in a tensioned state, supported from below by a bridge, between the tailpiece and the scroll of the neck.

BACKGROUND ART

There are several conventional bowed instruments. In members of the violin family, the tailpiece is a component carved of ebony or rosewood that is connected to the button secured to the lower end block by means of a string force. In the mandolin and certain acoustic and electric guitars with metal strings it is made of metal, and is screwed to the lower end block or to the body of the instrument. In guitars, the tailpiece and the bridge are often implemented integrally (as a single piece), for example in the case of classical and flamenco guitars. In plectrum instruments of ancient times, and in folk instruments, the (knot-type) string bridge also forms the tailpiece.

Strings are the primary sound-generating components of bowed instruments.

A string is a thin, flexible cord that is capable of transverse vibration in its stretched state. It is typically made of animal gut, silk, plastic, or metal (the original meaning of the Hungarian word for string, "húr", was "gut"). The sound character of bowed instruments is fundamentally determined by the strings, but it also depends on the structure of the instruments, as the sound generated by the strings is radiated by the instrument's body.

Vibration of the strings can be induced in a number of ways, including:

- plucking (either manually—utilizing the fingers—or applying a manual plectrum or a mechanism, such as in the case of the harpsichord),
- hitting (applying a mechanism, like in the piano, or manually, with beaters, such as in the case of the cimbalom),
- rubbing (applying a bow, such as in the case of bowed instruments, or a mechanism, such as in the case of the hurdy-gurdy),
- a special case, wherein the vibration of the strings is induced by air flow (aeolian harp).

On a string emitting a constant-pitch sound, standing waves are produced: the cycle time of the string's vibration is determined by the free length thereof. The magnitude or amplitude of the vibration determines the volume, while the frequency of the vibration determines the pitch of the generated sound. Other characteristics of the string, for example its material, thickness, etc., as well as the touching of the string by the musician, affect tone colour. The adjustment of the pitch of the sound emitted by a string ("tuning") is performed, in the case of most instruments, by changing the degree to which the string is stretched.

If a stretched string that is fixed at both ends is deflected from its base state at a given point, it assumes an elongated triangular shape, and after it is released, the corner of the triangle starts moving in both directions along the string, running back and forth and reversing direction at the end points, while the string is "trying" to return to its base state. It is important to note that the characteristics of the movement of the string greatly depend on the location of the excitation, but this does not affect sound frequency. In the case of plucking, vibration subsides due to internal friction, but by applying a bow, the state characteristic of the instant of plucking can be maintained continuously.

For a string to be appropriate for musical purposes, i.e. such that it can emit a musical sound for as long as possible, it has to fulfil the following conditions:

- it has to have sufficient tension strength so that it can withstand the tension forces required for tuning,
- it has to be sufficiently flexible, such that it can indeed behave as a string and not as a vibrating flexible rod,
- consequently, it is important that if the material is harder or more rigid (for example, steel), it has an sufficiently great length-to-diameter ratio, but for example a silk string wrapped by a bronze cord will work with a relatively smaller length-to-diameter ratio,
- its longitudinal mass distribution has to be uniform. This does not exclude the combination of materials of different density.

The first bowed instruments were presumably the so-called "idiochord" instruments. These were made from various plant stalks by cutting longitudinal slits in the stalk, and stretching the thus separated fibrous bundle by small wedges at the ends. For example, the cornstalk fiddle has such configuration.

The next stage of improvement was the heterochord musical bow. In this instrument, a string made by twisting fibres of animal or plant origin is included that satisfies more stringent musical requirements.

During the improvement of bowed instruments, in various regions of the globe there were different materials available for making musical strings: in the East, silk, in Asian nomadic horse cultures, horsehair, in tropical regions, various plant fibres, and in the West, animal intestines ("catgut") were primarily utilized for this purpose.

High-quality gut (catgut) strings are made of sheep, goat, or lamb intestines, but for more modest purposes the intestines of calves, rabbits, or cats are also appropriate. Intestines are mostly made up of muscle fibres, which explains their extraordinary elasticity. After cleaning, bleaching, etc., the intestines are cut to thin cords, followed by twisting as many cords together as required to form a string of the desired diameter, which is then dried, burnished, and polished.

For thousands of years, gut strings used to be the most widespread type of string, when, in the middle of the 20th century, they began to be substituted with plastic. The sound quality of nylon strings is on a par with the sound of gut strings, while nylon strings are more durable.

Metal strings also have a long history: the primary materials for making them used to be copper and bronze. Steel strings started to become widespread in the 19th century, they were first used for pianos, and then for the violin. During the 20th century, aluminium also became a material applied for making strings.

The violin is the smallest and highest-tuned member of the violin family of bowed instruments, having 4 strings tuned a perfect fifth apart. The family also includes the viola, the cello (or violoncello), and the double-bass.

The lowest-pitch string is tuned to "small g", i.e. $G_3$, followed by the "one-lined D" ($D_4$), "one-lined A" ($A_4$), and the "two-lined E" ($E_5$) strings.

Music for violin is usually notated in violin key (or, in an alternative term, the G-key).

Due to the ever more demanding requirements set for the instrument, it became one of the instruments demanding the most complex expertise in musical instrument building. The combination of careful building practices and the development of a very sophisticated instrumental technique resulted in a high-performance instrument allowing for a virtuosity, dynamic and tone colour range that surpass other bowed instruments. The violin is probably the most popular—but certainly the most ubiquitous and most sought-after—of all bowed instruments.

The present shape of the violin developed in around the 15th century. Its major components are the ribs (sides), an arced top plate, front and back plate, a neck terminating in a scroll, a fingerboard, a tailpiece, bridge, and the pegs. The design the shape and size of the violin —based on the golden ratio—has proved to be so perfect that the same configuration has been used even to the present day.

The shape, configuration and structural components of the violin have been practically unchanged for the past 300 years, and moreover, the composition of the adhesive applied for assembling the components and the composition of the stains and varnishes utilized for material surface treatment also remains the same.

The configuration of conventional violins is described in relation to FIG. 1. Violins comprise a body 2 that forms the resonating body of the instrument. Its function is to transmit the vibration of the strings and radiate it as sound into the surrounding space. Seen from the front, it has a distinctive hourglass shape, its narrowed "waist" allowing the unobstructed movement of the bow for sounding any one of the strings.

The upper plate of the body 2 is the top plate 4 that preferably consists of two spruce pieces that are cut "on the quarter", are symmetrically fitted together in the middle, and are carved to a slightly arched shape. This is the component of which the material, shape, thickness, and finish affect the sound quality of the instrument to the greatest extent. The bridge 13, a particularly elaborate component adapted for transmitting the vibration of the strings 14 to the top plate, is fitted against the latter near the middle. The so-called F-holes 10—that, on the one hand, are applied for lightening the top plate to allow the freer vibration of the bridge 13, and on the other hand are adapted to provide a degree of openness to the cavity of the resonator body, i.e. the body 2—are arranged symmetrically at both sides of the bridge 13. The top plate 4 is reinforced on the inside by a longitudinally extending rod, the so-called bass bar, that is arranged slightly asymmetrically, under the lower-pitched strings.

From the rear, the body 2 is terminated by the back plate 6 that has a similar configuration to the top plate 4, the difference being that it is made of a harder material, i.e. of maple wood, and does not comprise either a hole or reinforcing bar. It can be made integrally, or by joining two symmetrical pieces such as the top plate 4.

The top plate 4 and the back plate are interconnected by the ribs 5; due to the special shape of the violin, the ribs comprise six individual maple wood plates that are bent to different shapes, and are secured to each other by so-called blocks. On the inside of both of their edges there extend so-called linings for increasing the adhesion surface area for the attachment of the top plate 4 and the back plate 6. A button 24, made of hardwood—on which the tailpiece 9 (that optionally also includes the fine tuners) is hung—is connected to the lower end block. This component is adapted for securing the player-facing ends of the strings.

The sound post of the violin (also called "âme" i.e. "soul" in continental Europe) is a small cylindrical rod that is disposed inside the instrument, wedged between the top plate 4 and the back plate 6, approximately under that side of the bridge 13 that is located under the high-pitched strings. It is not secured by gluing, such that its position can be adjusted utilizing a special tool inserted through the F-hole 10. If it is removed, the instrument goes completely silent, but displacing it even by a millimetre results in significant changes in sound quality. This component can be found in most bowed instruments, its primary function is to transform the bow-induced vibrations of the strings 14 (that are nearly parallel to the plane of the top plate 4) into vibrations with a plane perpendicular to the top plate 4 such that they can be transferred to and by the top plate 4. This is achieved by the sound post by providing a relatively firm support (pivot point) under one of the "feet" of the bridge 13 such that almost all vibration energy can be transmitted to the other "foot", which energy can then be distributed over the entire top plate 4 by means of the bass bar.

The neck 1 is fitted to the upper end block of the body 2, slightly reclined with respect to the longitudinal axis of the body. It is made of maple wood, and on the top face thereof there is disposed the fingerboard 3 that extends a long way above the top plate 4. At its other end there is disposed the peg box 7, with the scroll 8 shaped tuning head and the pegs 12. Notes of different pitch are generated by the player by pressing the strings downwards against the fingerboard 3, so the neck 1 is shaped such that it ergonomically fits into the player's palm. The fingerboard 3 is made of ebony, and has a slightly convex cross-section corresponding to the curvature of the bridge 13. The nut 11 forming one of the vibrational terminal points of the strings 14 is disposed at the distal end of the fingerboard 3.

The tuning head, terminated in a scroll-shaped carving, can be considered as the "signature" of the instrument maker. This is respected to such an extent that, in case the neck 1 of a precious instrument has to be replaced, the tuning head is cut off from the original neck 1 and is fitted on the replacement. From the nut 11, the strings are run to a trough-like recess in the peg box 7, wherein they are wound on the transversely inserted pegs 12. The latter are made of ebony or grenadilla wood by turning; it is important that they are very accurately fitted—applying a conical fit—in the bores of the head, because the accurate tuning of the instrument depends on the quality of this fit. The conical shape is important for properly securing the pegs.

As far as the materials utilized for making the instruments are concerned, the top plate, the bass bar, the sound post, the blocks and the linings are made of wood from coniferous trees, i.e. spruce, while the back plate, the ribs, the neck, the peg box with the scroll and the bridge are made of semi-hard wood from deciduous trees, i.e. of maple. Because it is subjected to high loads and wear and tear, ebony is utilized for making the fingerboard. The pegs, the tailpiece, the button and the chin rest can be made of rosewood, boxwood, ebony, or other exotic wood materials.

The strings of the instrument are disposed between the tailpiece and the tuning head.

The configuration of a conventional tailpiece 9 that forms the lower points of attachment of the strings 14 is illustrated in FIG. 2 The tailpiece 9 is originally a small, hard metal plate, with four holes 15 being disposed along the upper, wider end, and with small, narrow slits—not shown in the drawing—being connected to the holes. The holes 15 and slits—GDAE—adapted for receiving the strings 14 are configured to be relatively narrow for the easy installation and handling of the strings 14. The nut of the conventional tailpiece 9 comprises an edge machined to a hemispherical shape. It is important that all portions of the tailpiece are rounded off.

Over the centuries, tailpieces have been modified many times. For example, such a modification was devised by Zahn, who tried to fix the upper end of the tailpiece, and replaced the slits with bores, securing the strings passed through them with knots.

His intention was to increase the resistance of the strings, and to achieve the regular vibration of the strings.

For affixing the tailpiece 9 to the button, pieces of thick string were conventionally applied (see in O. P. Apain Bennewiti: A hegedű építés alapismeretei (The essentials of violin building), Ernh Friedr Voight Kiadó 1892, Hungarian translation republished in 1992 and privately published in 2004).

A number of technical solutions have been proposed for further improving the tailpieces of bowed instruments. Such solutions are disclosed in the documents DE 19515166 A1, EP0242221 A2, DE 29712635 U1, U.S. Pat. No. 5,883,318, DE 2845241 A1, WO 2012/150616 and in EP 0273499 A1.

The inventions EP 1,260,963 and HU 225,320 disclose a tailpiece that essentially retains the shape of the tailpieces depicted in FIG. 2. The tailpiece is fitted with a tailpiece body on which a string holder mechanism is arranged that comprises an engaged loop forming an engagement arch adapted for securing the tailpiece to the musical instrument.

For easier operation, the body of the tailpiece comprises an adjustment mechanism adapted for adjusting the distance of the apex point of the engagement arch of the engaged string from the tailpiece, wherein the adjustment mechanism can be operated from the direction of a lateral side of the tailpiece.

In the case of the tailpiece disclosed in the document US 2012/0285311, the openings adapted for receiving the strings are arranged along an asymmetrical arced opening, as a result of which the strings have different length.

The document US 2017/0278489 discloses a tailpiece primarily for a plucked instrument that is configured as a multilayer, hollow tailpiece, wherein the openings adapted for receiving the strings are arranged along an arced side.

String tension is adjusted applying pegs.

The document US 2003/0217633 discloses a tailpiece for bowed instruments that is disposed on the top plate of the instrument, is secured to the top plate at the lower bout of the instrument, and is adapted for receiving the bottom portion of the strings. This known tailpiece can be considered as a shorter variant of the conventional tailpiece, wherein the elongated foot portion of the conventional tailpiece (of which the upper portion comprises bores receiving the string of the instrument) is omitted.

The known technical solutions, on the one hand, have complex configuration, and on the other hand, they are essentially variants of the conventional tailpiece but do not affect significantly the sound of the instrument.

Disclosure of Invention

The objective of the present invention is to provide a bowed instrument comprising a tailpiece that eliminates the drawbacks of known technical solutions, provides easier handling, and a significantly improved, more enjoyable sound.

The invention is based on the recognition that by providing an arced configuration of the conventional, elongated upper portions that are adapted for receiving the strings of the tailpiece, and by securing the strings to the upper portion of the tailpiece at different heights, the free movement of the resonator body and the strings can be improved, which results in a more "sensitive" sound of the instrument, because the resistance of the strings is greatly reduced, and string resonance becomes controllable, and, in addition to that, the operation (vibration) of the strings—which are stretched to a different degree—become more uniform, which greatly improves the sound of the instruments.

A further recognition of the invention is that, in the case of a bowed instrument comprising the tailpiece of the invention, the strings have different length, and, due to the configuration of the tailpiece, their stretching is more uniform, so the strings can be sounded more easily, and have a more relaxed sound.

The objectives according to the invention have been fulfilled by providing a bowed instrument comprising a body and a neck, the upper face of the body being the top plate, at the bottom of which a tailpiece is disposed secured to the bottom of the instrument, the strings being disposed in a tensioned state, supported from below by a bridge, between the tailpiece and the scroll of the neck, the bowed instrument comprising a tailpiece that is adapted to retain the bottom portion of the strings, has an arcuate triangular shape, has an asymmetrically shaped body made of a multilayered material, and is rounded along the periphery of its body, wherein a bore adapted for securing the tailpiece to the bottom of the bowed instrument is disposed at the bottom corner, with bores that have different length and are adapted for receiving the strings being disposed along the arced portion extending between the two upper corners thereof.

In a preferred embodiment of the bowed instrument according to the invention, the tailpiece is a multilayered body that is formed of a core portion, at least one reinforcing layer adapted for bounding the core portion on both sides, and an at least one-layer cover layer adapted for bounding the reinforcing layer on both sides, where the core portion is made of at least of the following wood materials: ebony, mahogany, afzelia, iroko, afrormosia, cabreuva, lapacho, teak, rosewood, jatoba, merbau, mutenye, wenge, panga panga, kempas, bangkirai, khaya, the reinforcing layer(s) being made of at least one of the following materials: Kevlar, carbon fabric, graphene.

In another preferred embodiment of the bowed instrument according to the invention there are adhesive bonds between the layers of the multilayer body of the tailpiece, wherein the adhesively bonded layers are formed of a cyanide-containing adhesive, and/or a thermosetting resin adhesive.

In a further preferred embodiment of the bowed instrument according to the invention, the bores of the tailpiece that are adapted for receiving the strings have a chamfered edge configuration.

In an expedient embodiment of the bowed instrument according to the invention, the function describing the arced section extending between the corners of the arced portion of the upper portion of the tailpiece adapted for receiving the bottom end of the strings is the function portion defined by the following equation and values:

$$y=a+bx+cx^2+dx^3+ex^4+fx^5$$

$$x \in [-12.96\ldots;\ 20.84\ldots]$$

| | | | $x_a$ | $y_a$ |
|---|---|---|---|---|
| a | 0.000000000000000888 | $R^2$ | −12.96831103 | 9.6360373 |
| b | 0.0163847606654536 | $aR^2$ | −9.4331008 | 4.09804496 |
| c | 0.0326450466094223 | P | 0 | 0 |
| d | −0.000710668554553942 | SE | 1.82034226 | 0.13460043 |
| e | 0.000083073284331152 | F | 13.57826781 | 6.70859988 |
| f | −0.000001250897129314 | | 20.84428892 | 18.84923295 |

A further expedient embodiment of the bowed instrument according to the invention further comprises a spacer member or spacer members that is/are disposed between the bridge and the tailpiece and is/are adapted for being displaced upwards and downwards along the strings, wherein the spacer members have block-like configuration, with grooves adapted for receiving the strings being formed in the lateral faces of the blocks.

The length values of the strings applicable with the bowed instrument according to the invention are specified in Table I.

BRIEF DESCRIPTION OF DRAWINGS

The bowed instrument according to the invention and the tailpiece thereof are explained in detail referring to the attached drawings, where.

BEST MODE OF CARRYING OUT THE INVENTION

Figure 3:
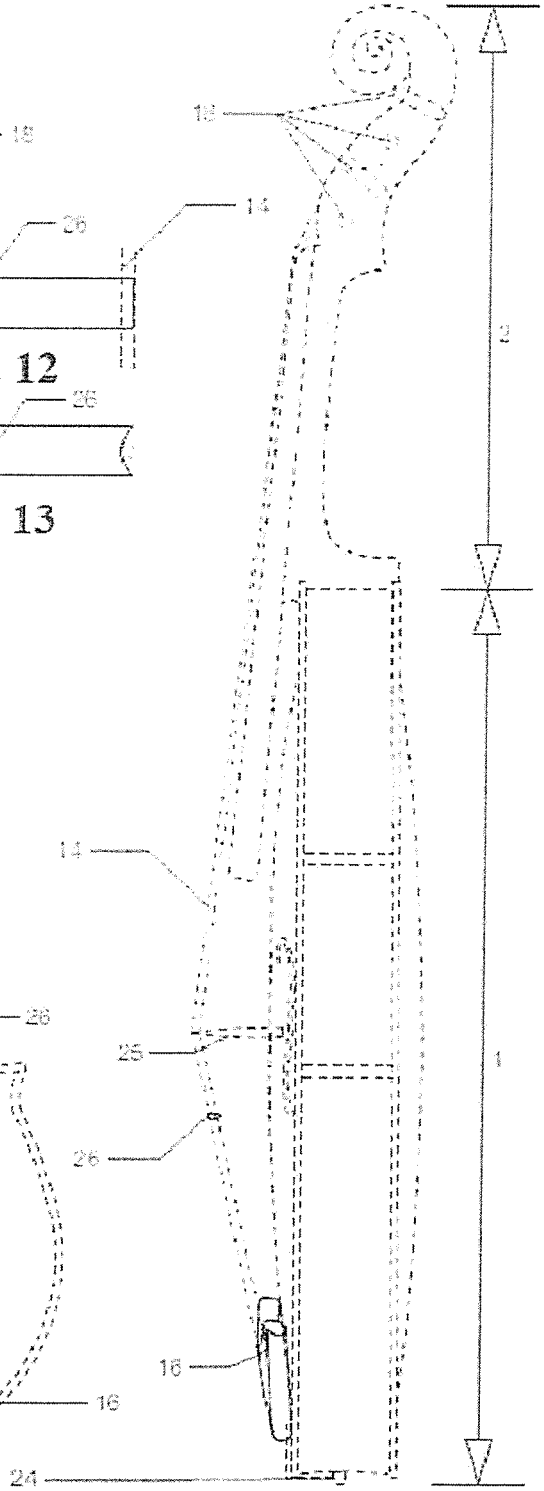
FIG. 3 shows a side elevation view of the bowed instrument—particularly, violin—according to the invention.

FIG. 3 shows a side elevation view of the bowed instrument—in this case, a violin—according to the invention.

Figure 1:
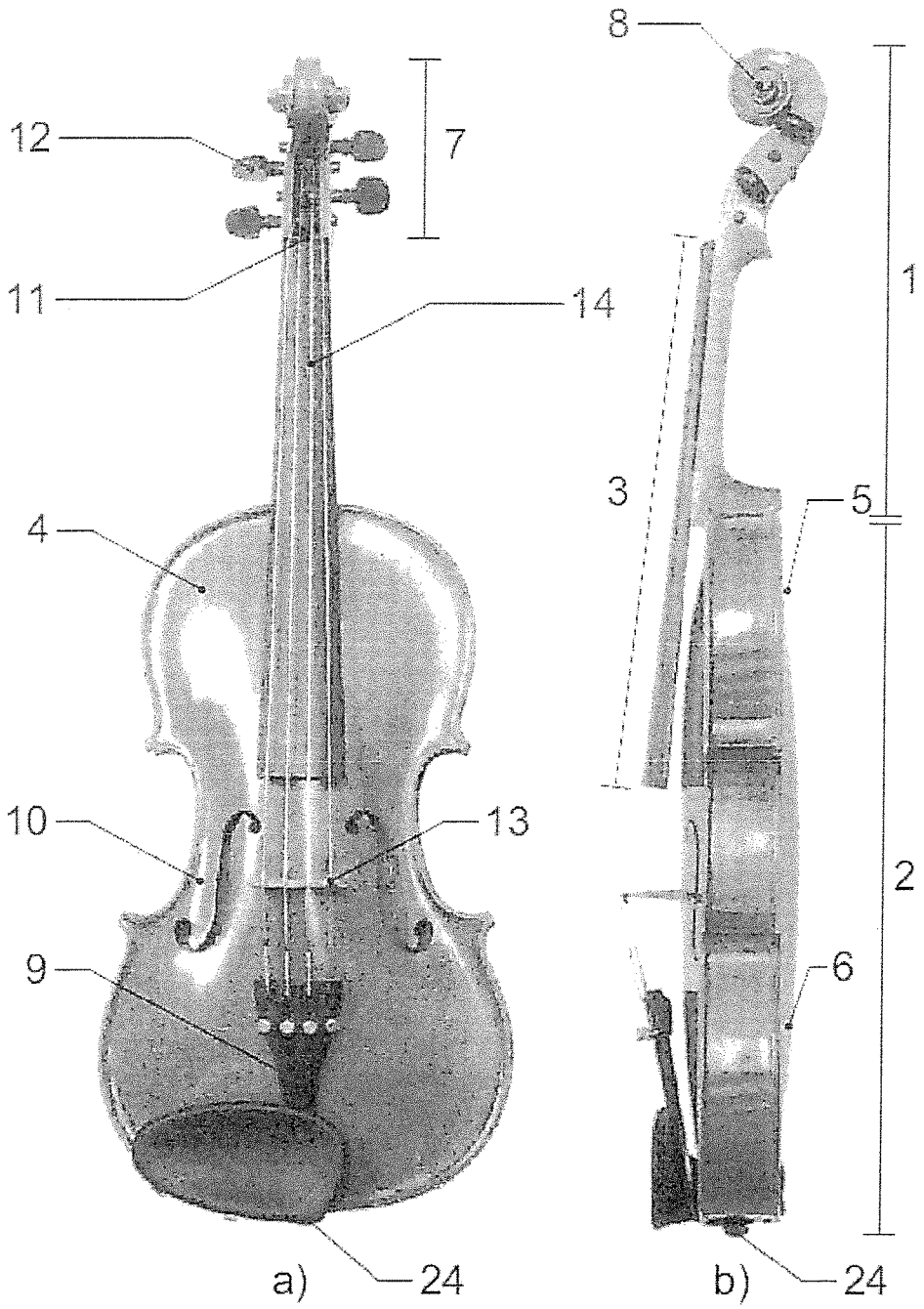
FIG. 1 shows a front view (a) and a side view (b) of a bowed instrument—violin—comprising a tailpiece known per se.
Figure 2:
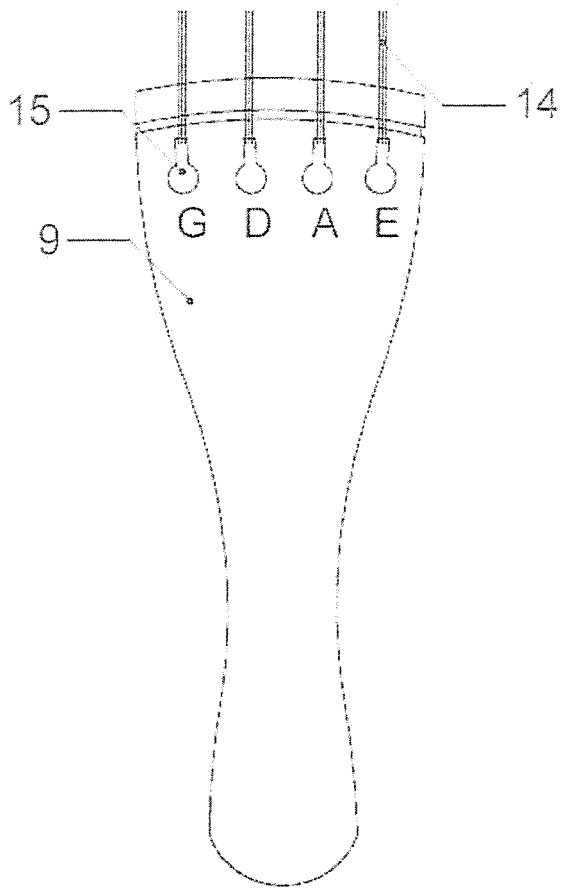
FIG. 2 shows a magnified view of the tailpiece shown in FIG. 1.

The configuration of the bowed instrument according to the invention is essentially identical to the configuration of the conventional instrument shown in FIG. 1, i.e. the configuration of the body 2 and the neck 3 has not been modified.

The role of the bridge 13 has been taken over by a bridge 25. However, the configuration of the tailpiece 16 situated at the bottom of the instrument is completely different from known technical solutions. The configuration of the tailpiece 16 will be described in detail herebelow.

The tailpiece 16 is adapted for receiving the bottom end of the strings 14, the tailpiece 16 being attached to the bottom of the instrument at a single point by a button 24.

Figure 4:
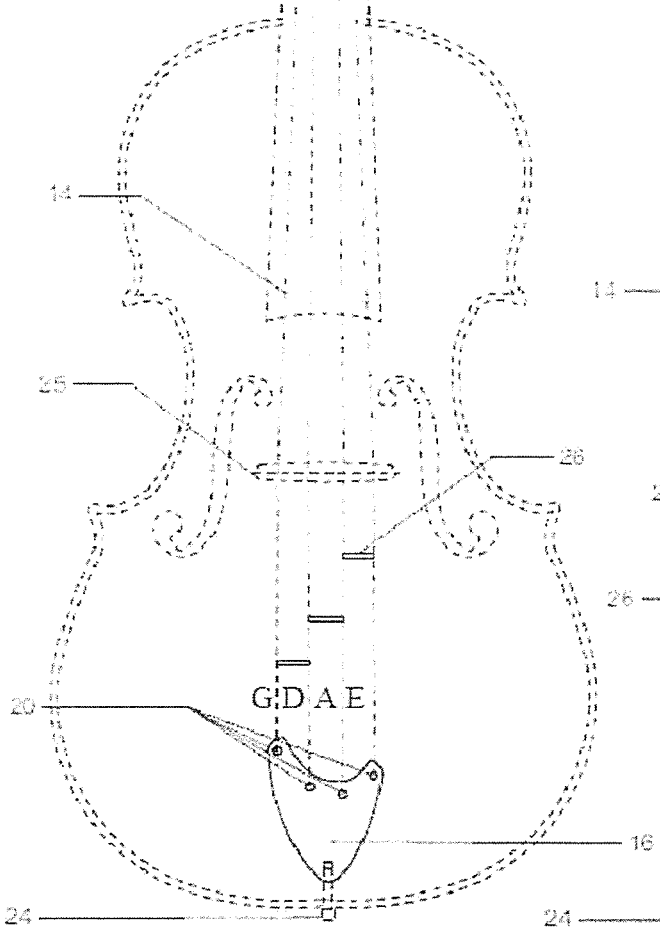
FIG. 4 is a partial front view of the bowed instrument according to FIG. 3.

FIG. 4 illustrates the bowed instrument according to FIG. 3 in front view, also indicating the strings, with spacer members 26 adapted for being moved upwards and downwards along the strings 14 being disposed at the portion between the tailpiece 16 and the bridge 25 with the aim of eliminating undesirable out-of-tune sounds It has to be noted that the spacer members 26 are only optionally included, i.e. they can be omitted.

Figure 5:
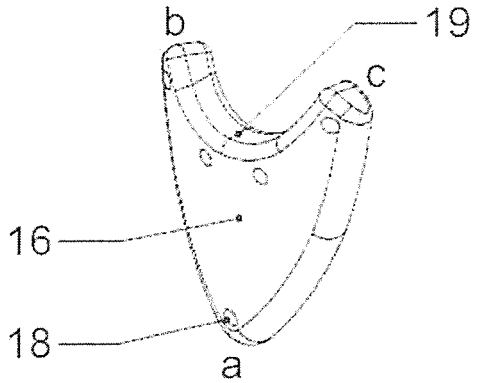
FIG. 5 is a perspective view of the tailpiece applied with the bowed instrument according to the invention.

FIG. 5 shows the configuration of the tailpiece 16 of the bowed instrument according to the invention in perspective view.

The tailpiece 16 is a body having an upwardly widening configuration, of which the upper right end, shaped symmetrically to the axis 17, has greater length. The tailpiece 16 is essentially a body having an asymmetrical arcuate triangular shape, of which the corner c is situated higher than the corner a, with the corners b and c being interconnected by an arced portion 19 (see FIG. 6), said arced portion 19 constituting the upper side of the tailpiece 16.

A bore 18 is disposed on the tailpiece 16 above the bottom corner a thereof that is adapted for affixing the tailpiece 16 to the bottom portion of the bowed instrument—for example, violin—, i.e., to the button 24 thereof (see FIG. 3).

It has to be noted here that it is usually sufficient to affix the tailpiece 9 to the instrument by means of a single bore, but, in certain cases, attachment applying two bores can also be considered. Such attachments can be implemented applying thorugh-bores or hidden bores.

Single-point attachment has a more favourable effect on the covibration of the instrument. In the case of a two-point attachment, the above mentioned covibration can be reduced, as a result of which the vibration of the lower run of the string (situated below the bridge 25) will become more dominant.

Figure 6:
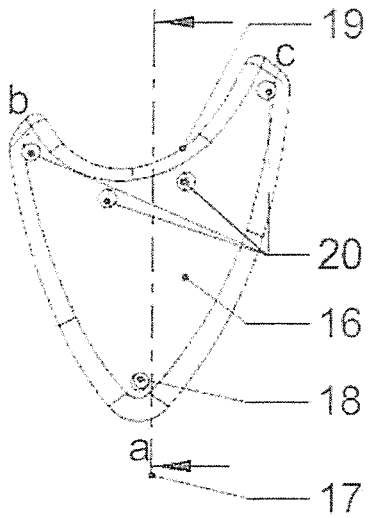
FIG. 6 shows a front view of the tailpiece according to FIG. 5.

Along the arced portion 19 interconnecting the upper corners b and c of the tailpiece 16 there are disposed four bores 20 that are adapted for receiving the strings (the latter are not shown in the figure, see FIG. 6). The bores 20 have a bevelled/chamfered edge configuration.

The G and E strings are affixed in the bore 20 situated under the corner b, and in the bore 20 situated under the corner c, respectively, with the D and A strings being affixed along the arced portion 19 interconnecting the corners b and c, along both sides of the axis 17.

Figure 7:
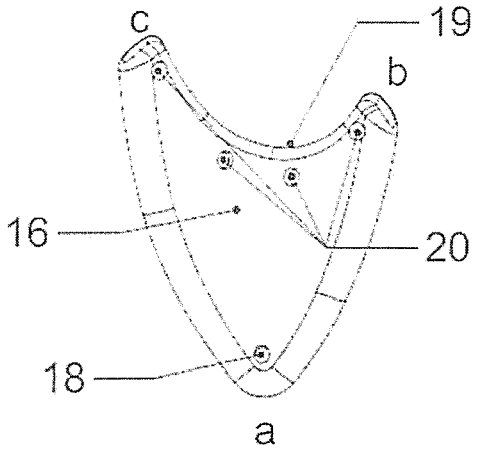
FIG. 7 shows a rear view of the tailpiece according to FIG. 5.

In FIG. 7, the rear view of the tailpiece 16 of the bowed instrument according to the invention is shown. It is noted that, if it is allowed by the characteristics of the instrument, the tailpiece 16 can be attached to the instrument also in this configuration. In that case, the G and E strings are of course affixed in the bore 20 situated under the topmost corner c of the tailpiece 16, and in the corner b, respectively.

Figure 8:
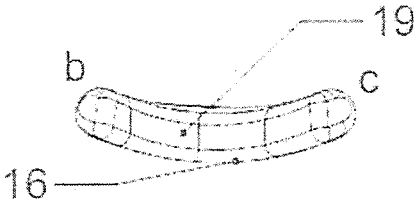
FIG. 8 shows a top plan view of the tailpiece according to FIG. 5.
Figure 9:
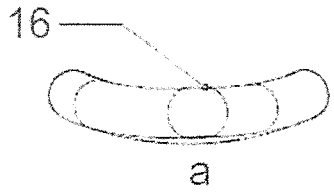
FIG. 9 shows an underside view of the tailpiece according to FIG. 5.

In FIG. 8 and FIG. 9, the tailpiece 16 is shown in top plan view and in underside view, respectively.

As can be seen in FIGS. 5-9, there are no sharp edges and corners along the lateral faces of the tailpiece 16, i.e. all faces have a bevelled configuration. It should be noted that the tailpiece 16 can have a convex or flat configuration.

Figure 10:
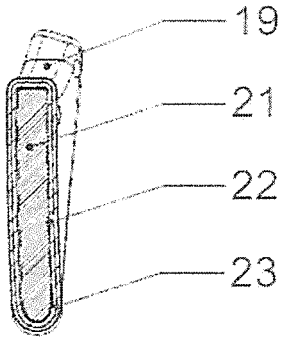
FIG. 10 shows a view taken along the section plane I-I according to FIG. 5.

FIG. 10 shows a sectional view taken along the section plane I-I of FIG. 6.

The tailpiece 16 is a solid body consisting of multiple layers. Depending on the type of the applied materials and the characteristics of the instrument, the number of layers varies between 7 and 14.

In this embodiment, the tailpiece 16 is a violin tailpiece, wherein the tailpiece 16 consists of the following layers: internal core portion 21, reinforcing layer 22, cover layer 23, where the internal core portion 21 is made of ebony. The core 21 is encompassed on both sides by a respective reinforcing layer 22—made preferably of Kevlar—, the layers 22 are topped on each side by two cover layers 23 that are made of ebony, mahogany, afzelia, iroko, afrormosia, cabreuva, lapacho, teak, rosewood, jatoba, merbau, mutenye, wenge, panga panga, kempas, bangkirai, khaya.

Carbon fabric and graphene can also be applied instead of Kevlar reinforcement.

The layers can be bonded together applying a cyanide-containing adhesive, and/or a thermosetting resin adhesive.

In the case of an instrument comprising the tailpiece 16, the tailpiece 16 is affixed to the button 24 at the bottom of the instrument at a single point, as a result of which the tailpiece 16 can be inclined with respect to the strings 14.

In the case of the violin, the axis of this inclination is parallel to the strings, while in the case of the double-bass and the viola, the inclination angle is preferably 3.7° and in the case of the cello, 7.8°.

This inclination has a favourable effect on the sound of the instrument.

Figure 11:
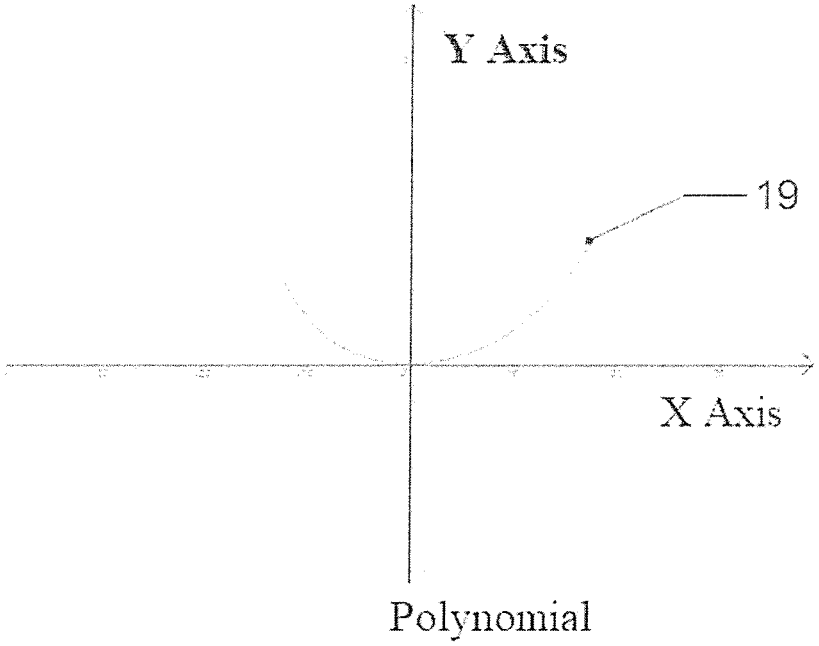
FIG. 11 shows the curve describing the upper portion of the tailpiece according to FIG. 5.

FIG. 11 shows the curve of the function—a polynomial function—that describes the arced portion interconnecting points Y and Z of the tailpiece 16.

$$y=a+bx+cx^2+dx^3+ex^4+fx^5$$

where $$y=0.000000000000000888+0.0163847606654536x+0.0326450466094223x^2+-0.000710668554553942x^3++0.000083073284331152x^4+-0.000001250897129314x^5$$

$$x \in [-12.96\ldots;\ 20.84\ldots]$$

| | | | $x_a$ | $y_a$ |
|---|---|---|---|---|
| a | 0.000000000000000888 | $R^2$ | −12.96831103 | 9.6360373 |
| b | 0.0163847606654536 | $aR^2$ | −9.4331008 | 4.09804496 |
| c | 0.0326450466094223 | P | 0 | 0 |
| d | −0.000710668554553942 | SE | 1.82034226 | 0.13460043 |
| e | 0.000083073284331152 | F | 13.57826781 | 6.70859988 |
| f | −0.000001250897129314 | | 20.84428892 | 18.84923295 |

Second-order polynomial: (SSE=0.547) $x \in [0.53]$ $-0.00938455 \cdot x^2+0.52331792 \cdot x--0.01674261$ Third-order polynomial: (SSE=0.403) $x \in [0.53]$ $3.97677664 \cdot 10^{-5} \cdot x^3-1.25425892 \cdot 10^{-2} \cdot x^2+5.84860760 \cdot 10^{-1} \cdot x-1.73194702 \cdot 10^{-1}$ Fourth-order polynomial: (SSE=0.106) $x \in [0.53]$ $$y=(4.24340772 \cdot 10^{-6}) \cdot x^4-(4.07083511.10^{-4}) \cdot x^3+(1.98383363 \cdot 10^{-3}) \cdot x^2+(4.39330062 \cdot 10^{-1}) \cdot x-(3.13336927 \cdot 10^{-2})$$

Fitted measured points:
=[x, y]=0; 0
8; 3.3
18; 6.8
28; 7.3
38; 6.13
48; 3.12
53; 1.7

The portion of the function that defines the arced portion 19 values is obtained by the values calculated for the fitted points (x, y).

It has to be noted that the function describing the arced portion 19 is also a family of parametric functions.

Returning now to the configuration of the tailpiece 16, as it has already been mentioned, the tailpiece 16 does not have any sharp corners or edges, with all of its faces being bevelled/chamfered; and, for making "invisible" the layers making it up—as with the bowed instrument itself, see FIG. 1—, the external portion thereof is provided with a cover that can be made integral or can consist of multiple interconnected pieces.

It is noted here that, by default, the tailpiece can be installed without fine tuners, but, if it is made necessary by the characteristics of a given instrument, fine tuners can be also included.

For fine tuning and for eliminating possibly occurring out-of-tune sounds, the bowed instrument according to the invention can also comprise a spacer member (or spacer members) 26 that are disposed between the strings 14 and can be displaced upward or downward between the tailpiece 16 and the bridge 24 (see FIG. 4).

Figure 12:
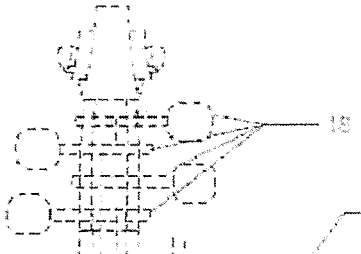
FIG. 12 illustrates the spacer member applied with the bowed instrument according to the invention.
Figure 13:
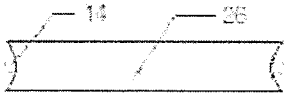
FIG. 13 is the side elevation view of the spacer member according to FIG. 12.

The configuration of the spacer member 26 can be observed in FIGS. 12 and 13.

The spacer member 26 is essentially an oblong block-shaped member, with grooves 27 adapted for receiving the strings 14 being formed in the lateral faces thereof.

As can be seen from the configuration of the tailpiece 16 for bowed instruments according to the invention, unlike with instruments fitted with conventional tailpieces (see FIG. 1), the strings have different lengths. The length of the bottom section of the string—the E string—affixed in the bore 20 of the corner C is the smallest, but the lengths of certain strings are different from the length of the strings applied for instruments having conventional tailpieces.

This results in significant differences in sound, as well as in the easier handling of the instrument.

It has to be noted that, although the configuration of the instrument according to the invention and the tailpiece applied therefor were described referring to application with a conventional violin, the tailpiece can be applied on any other bowed instrument, the length of the strings varying according to the characteristics of the particular instrument.

The tuning arrangements of strings on bowed instruments are the following (going from thicker to thinner strings):

violin: GDAE viola: CGDA cello: CGDA, or, in the case of the five-string Baroque cello: CGDAE double-bass: EADG, or, in the case of the five-string double-bass: EADGB The string length values applied for the bowed instruments comprising the tailpiece 16 according to the invention are summarized in the table below:

TABLE I

| Instrument | String name | Total length (mm): | B string length of twisted section above the bottom button (mm): | length of playable metallic twisted section of string (mm): | length of upper twisted section for being wound on peg |
|---|---|---|---|---|---|
| Violin | G | 510-680 | 10-30 | 400-500 | 100-150 |
| | D | 580-700 | 10-30 | 470-520 | 100-150 |
| | A | 600-740 | 10-30 | 470-530 | 120-180 |
| | E | 540-660 | 10-30 | 450-500 | 80-130 |
| Viola | C | 645-795 | 15-35 | 530-600 | 100-160 |
| | G | 685-820 | 15-30 | 540-620 | 130-170 |
| | D | 735-835 | 15-35 | 570-620 | 150-180 |
| | A | 675-795 | 15-35 | 530-590 | 130-170 |
| Cello | C | 1140-1235 | 40-60 | 960-1010 | 140-165 |
| | G | 1150-1240 | 40-60 | 970-1020 | 140-160 |
| | D | 1190-1290 | 40-60 | 970-1020 | 180-210 |
| | A | 1180-1260 | 40-60 | 950-980 | 190-220 |
| Double-bass | E | 1880-1950 | 50-70 | 1600-1630 | 230-250 |
| | A | 2020-2095 | 50-70 | 1640-1665 | 330-360 |
| | D | 2050-2115 | 50-70 | 1650-1675 | 350-370 |
| | G | 2010-2725 | 50-70 | 1650-1675 | 310-340 |

The tailpiece for bowed instruments according to the invention has the following advantages:

- it functions as a resonance control means,
- by its application, a bigger, more resonant sound and a wider tone range can be achieved,
- although tone decay time is not much longer compared to conventional tailpieces, by applying an appropriate bow technique a much richer and more dynamic sound can be achieved; the impression is as if there was an additional "layer" of resonance available for shaping the sound,
- it makes everyday instrumental practice more enjoyable,
- the resistance of semitones produced during playing the instrument is reduced and is made more uniform, allowing for a greater difference in volume,
- the vibrations of the bottom string section (situated downwards from the bridge) helps the formation of a novel frequency range; besides that, it makes the "wolf tone" (that can be found on almost all high-quality bowed instruments) manageable, by reducing or completely eliminating its naturally incompatible vibrations,
- subjectively, the instrument is much easier to play on, which first and foremost manifests itself in the more flexible application of string pressure with the left hand, and, in the case of the right hand (the bow hand), in more easier achievement of the vibration of the strings utilizing the bow,
- vibrato (i.e. periodically modifying the pitch of the tone being played utilizing the player's left hand) also becomes more dynamic—the spectral range of the vibrated tone becoming wider—exhibiting a hitherto unprecedented added quality, which opens up completely novel possibilities in sound production that may also result in the new directions of progress for instrumental practice,
- during education for playing bowed instruments, it makes tuning the instrument more easier (more easily audible) for the pupil.

LIST OF REFERENCE NUMERALS

1 neck
2 body
3 fingerboard
4 top plate
5 rib
6 back plate
7 peg box
8 scroll
9 tailpiece
10 F-hole
11 nut
12 peg
13 bridge
14 string
15 hole
16 tailpiece
17 axis
18 bore
19 arced portion
20 bore
21 core portion
22 reinforcing layer
23 cover layer
24 button
25 bridge
26 spacer member
27 groove

The invention claimed is:

1. Bowed instrument comprising a body and a neck, the upper face of the body being the top plate, at the bottom of which a tailpiece is secured to the bottom of the instrument, the strings being disposed in a tensioned state, supported from below by a bridge, between the tailpiece and the scroll of the neck, characterized in that it comprises a tailpiece that is adapted to retain the bottom portion of the strings, has an arcuate triangular shape, has an asymmetrically heart-shaped body made of a multilayered material, and is rounded along the periphery of its body, wherein a bore adapted for securing the tailpiece to the bottom of the bowed instrument is disposed at the bottom corner, with bores that have different length and are adapted for receiving the strings being disposed along an arced portion extending between the two upper corners thereof.

2. The bowed instrument according to claim 1, characterized in that the asymmetrically shaped body of the tailpiece (16) is formed of a core portion (21), at least one reinforcing layer (22) adapted for bounding the core portion on both sides, and an at least one-layer cover layer (23) adapted for bounding the reinforcing layer (22) on both sides.

3. The bowed instrument according to claim 2, characterized in that the material of the core portion (21) of the tailpiece (16) thereof is at least one of the following wood materials: ebony, mahogany, afzelia, iroko, afrormosia, cabreuva, lapacho, teak, rosewood, jatoba, merbau, mutenye, wenge, panga panga, kempas, bangkirai, khaya.

4. The bowed instrument according to claim 2, characterized in that the material of the reinforcing layer(s) of the tailpiece (16) is one of the following materials: poly-paraphenylene terephthalamide (Kevlar), carbon fabric, graphene.

5. The bowed instrument according to claim 2, characterized by an adhesively bonded connection between the core portion (21), reinforcing layer (22) and, core layer (23) of the tailpiece (16).

6. The bowed instrument according to claim 5, characterized in that the adhesively bonded connection is formed by a cyanide-containing adhesive, and/or a thermosetting resin adhesive.

7. The bowed instrument according to claim 1, characterized in that the bores (20) of the tailpiece (16) that are adapted for receiving the strings have a beveled/chamfered-edge configuration.

8. The bowed instrument according to claim 1, characterized in that a function describing the arced portion (19) of the upper portion of the tailpiece (16) adapted for receiving the bottom end of the strings is defined by the following equation and values:

$$y=a+bx+cx^2+dx^3+ex^4+fx^5$$

$$x€ [-12.96 \ldots ;20.84 \ldots ]$$

| | | | $x_a$ | $y_a$ |
|---|---|---|---|---|
| a | 0.00000000000000888 | $R^2$ | −12.96831103 | 9.6360373 |
| b | 0.0163847606854536 | $aR^2$ | −9.4331008 | 4.09804496 |
| c | 0.0326450466094223 | P | 0 | 0 |
| d | −0.000710668554553942 | SE | 1.82034226 | 0.13460043 |
| e | 0.000083073284331152 | F | 13.57826781 | 6.70859988 |
| f | −0.0000012508971129314 | | 20.84428892 | 18.84923295 |

9. The bowed instrument according to claim 1, characterized in that it further comprises a spacer member (26) held between adjacent strings, disposed between the bridge (25) and the tailpiece (16), and adapted for being displaced upwards and downwards along the strings (14).

10. The bowed instrument according to claim 9, characterized in that the spacer member has a block-like shape, with a groove (27) adapted for receiving the strings (14) being disposed at one of their side faces.

11. String for the bowed instrument according to claim 1, characterized in that the string (14) disposed between the tailpiece (16) and the scroll (8) of the neck (1) has a length specified in the table below:

| Instrument | String name | Total length (mm): | B string length of twisted section above the bottom button (mm): | length of playable metallic twisted section of string (mm): | length of upper twisted section for being wound on peg |
|---|---|---|---|---|---|
| Violin | G | 510-680 | 10-30 | 400-500 | 100-150 |
| | D | 580-700 | 10-30 | 470-520 | 100-150 |
| | A | 600-740 | 10-30 | 470-530 | 120-180 |
| | E | 540-660 | 10-30 | 450-500 | 80-130 |
| Viola | C | 645-795 | 15-35 | 530-600 | 100-160 |
| | G | 685-820 | 15-30 | 540-620 | 130-170 |
| | D | 735-835 | 15-35 | 570-620 | 150-180 |
| | A | 675-795 | 15-35 | 530-590 | 130-170 |
| Cello | C | 1140-1235 | 40-60 | 960-1010 | 140-165 |
| | G | 1150-1240 | 40-60 | 970-1020 | 140-160 |
| | D | 1190-1290 | 40-60 | 970-1020 | 180-210 |
| | A | 1180-1260 | 40-60 | 950-980 | 190-220 |
| Double-bass | E | 1880-1950 | 50-70 | 1600-1630 | 230-250 |
| | A | 2020-2095 | 50-70 | 1640-1665 | 330-360 |
| | D | 2050-2115 | 50-70 | 1650-1675 | 350-370 |
| | G | 2010-2725 | 50-70 | 1650-1675 | 310-340 |

* * * * *